US006416429B1

(12) United States Patent
Pecoraro et al.

(10) Patent No.: US 6,416,429 B1
(45) Date of Patent: Jul. 9, 2002

(54) AUTOMATED BATTING TEE APPARATUS

(75) Inventors: John J. Pecoraro, Pueblo; Robert E. Nicholson, Pueblo West, both of CO (US)

(73) Assignee: Quick Hit, Inc., Pueblo West, CO (US)

( * ) Notice: Subject to any disclaimer, the term of this patent is extended or adjusted under 35 U.S.C. 154(b) by 25 days.

(21) Appl. No.: 09/595,859

(22) Filed: Jun. 16, 2000

(51) Int. Cl.[7] ..... A63B 57/00; A63B 69/00

(52) U.S. Cl. ..... 473/417; 473/415; 473/134; 124/6

(58) Field of Search ..... 473/417, 419, 473/420, 422–429, 454, 462, 131–137, FOR 103, 415, 430, 432, 451, 452; 124/56, 64, 6; 273/400, 410, 446, 454

(56) References Cited

U.S. PATENT DOCUMENTS

| | | | | | |
|---|---|---|---|---|---|
| 1,667,481 | A | * | 4/1928 | Lange et al. | 473/136 |
| 3,778,067 | A | * | 12/1973 | Gentiluomo | 473/133 |
| 5,297,797 | A | * | 3/1994 | Lamontagne | 473/133 |
| 5,672,124 | A | * | 9/1997 | Pecoraro et al. | 473/417 |
| 5,848,945 | A | * | 12/1998 | Miller et al. | 473/417 |
| 5,997,405 | A | * | 12/1999 | Russell et al. | 473/140 |

* cited by examiner

*Primary Examiner*—Paul T. Sewell
*Assistant Examiner*—Mitra Aryanpour

(74) *Attorney, Agent, or Firm*—Flanagan & Flanagan; John R. Flanagan

(57) ABSTRACT

An automated batting tee apparatus includes a housing having a top opening, a ball dispensing mechanism for feeding balls one at a time to above the top opening, a ball holder tube forming a batting tee disposed upright in the housing and aligned with the top opening thereof and having an upper end portion for receiving a ball and a lower end portion spaced below the upper end portion, and a drive mechanism arranged upright in the housing externally of and alongside the ball holder tube for vertically moving the ball holder tube and actuating the ball dispensing mechanism. The housing includes a base that rest on the ground and an enclosure having an inner shell on the base and an outer shell slidably mounted over the inner shell and adjustable to different vertical positions relative to the inner shell to adjust the height of the upper end portion of the ball holder tube above the ground. The drive mechanism includes a pair of spaced upper and lower pulleys rotatably mounted to a frame supported by the outer shell within the inner shell and a flexible endless drive belt extending over and between the pulleys and movable therewith. An actuating linkage intercouples the ball dispensing mechanism to the endless drive belt so as to move the ball dispensing mechanism between a ball blocking position and a ball releasing position as the ball holder tube is moved by the endless drive belt between a lowered ball receiving position and a raised ball hitting position.

29 Claims, 6 Drawing Sheets

FIG. 7
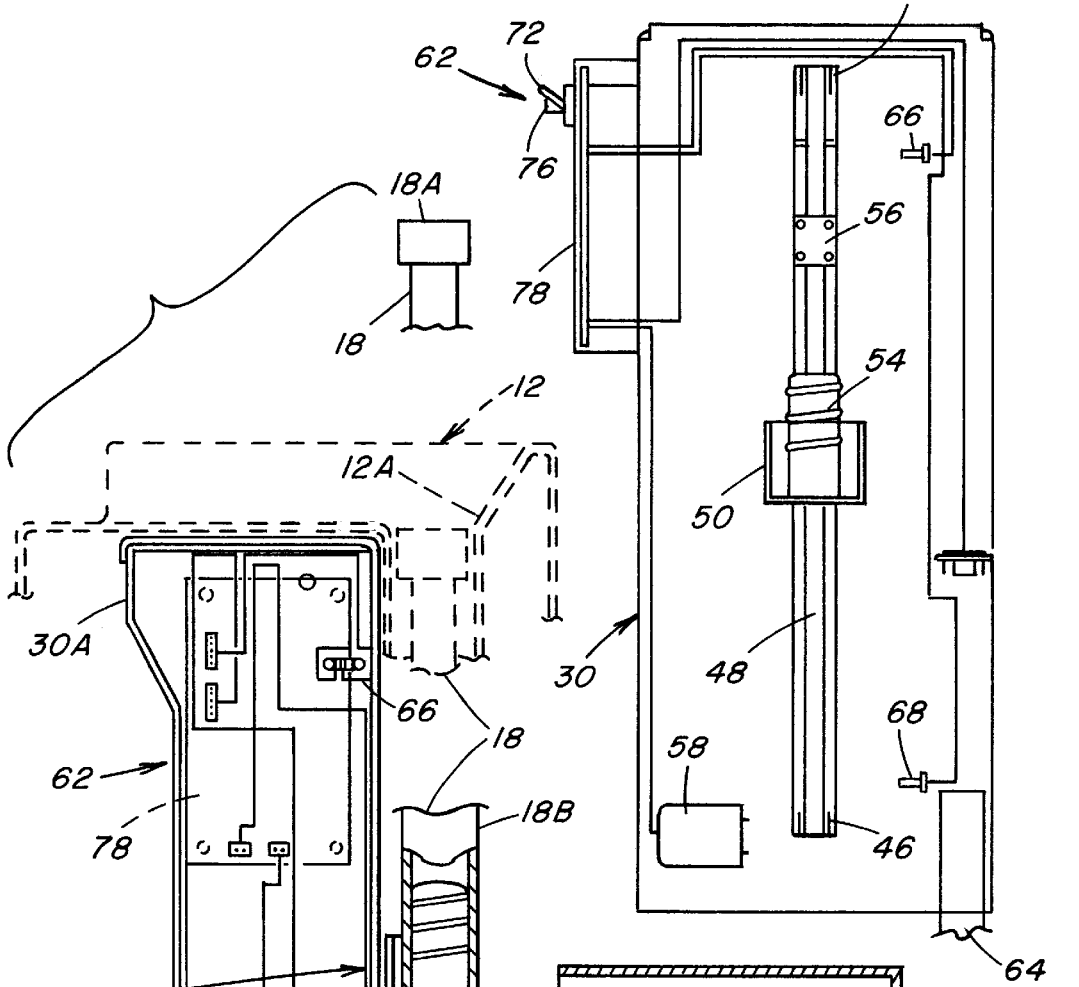
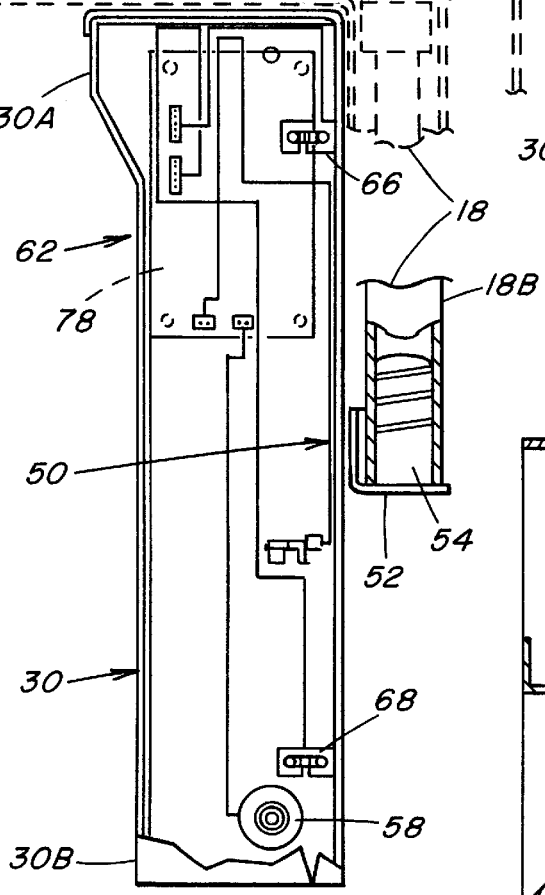
FIG. 6
FIG. 5

AUTOMATED BATTING TEE APPARATUS

BACKGROUND OF THE INVENTION

1. Field of the Invention

The present invention generally relates to devices for baseball or softball practice hitting and, more particularly, is concerned with an automated batting tee apparatus.

2. Description of the Prior Art

One of the most difficult skills to master in playing either baseball or softball is hitting the ball. The batter must be able to coordinate the swinging of the bat with the location of the ball so that good contact can be made with the ball. Also, the batter must be able to make good contact with the ball at the various positions at which it may cross homeplate in the batter's strike zone.

Good hitting takes lots of practice. A baseball tee is sometimes used to support a ball at the selected positions above the ground. The batter then hits the ball, after which the ball is retrieved and placed back on the tee for another practice swing. In this manner, the batter can practice swinging and improve hitting skills.

Various batting tees have been developed in the past for this purpose. However, in most cases, the tees require expenditure of considerable time, motion and energy just to manually replace a ball on the tee before each swing. This requirement takes away from the time and energy one has available to devote to practice hitting the ball. As a result, the use of manual baseball practice tees has not been widely accepted.

One recently developed automatic batting tee apparatus is disclosed in U.S. Pat. No. 5,672,124 to Pecoraro et al., which issued Sep. 30, 1997 and is assigned to the same assignee as the present invention. This automatic batting tee apparatus includes a housing having a top opening, a chute for feeding balls one at a time to above the top opening, an externally threaded rotatable drive screw member mounted upright in the housing for rotation about a vertical axis aligned with the top opening, a drive motor drivingly coupled to a lower end of the drive screw member for selectively transmitting rotary motion thereto, and an elongated ball holder tube disposed upright in the housing surrounding the rotatable drive screw member and aligned with the top opening. The ball holder tube is drivingly engaged with the externally threaded rotatable drive screw member at an internally threaded lower end portion of the ball holder tube and coupled to the housing so that in response to rotation of the drive screw member by the drive motor in one and the other of opposite rotational directions the ball holder tube will undergo upward and downward reciprocal movement along the vertical axis relative to the rotating drive screw member through a ball receiving and positioning cycle.

This patented automatic batting tee apparatus alleviates the drawbacks associated with the prior art manual batting practice tees in that the user of this automatic apparatus does not have to manually place each ball on the batting tee thereby saving a considerable amount of motion, time and energy. Instead, a number of balls are placed in a hopper or ball feeder and fed by gravity one at a time onto the tee. Also, this automatic apparatus provides an actuation device in easy reach of the batter for the batter to actuate after each practice hit in order to reload the tee with a new ball.

While this patented automatic batting tee apparatus has functioned satisfactorily in achieving its intended purpose, after an initial period of use a need for improvement has been recognized to make the apparatus more cost-effective and durable and easier to operate so that its utilization as an aid to hitting practice will become more generally acceptable.

SUMMARY OF THE INVENTION

The present invention provides an automated batting tee apparatus designed to satisfy the aforementioned need. The automated batting tee apparatus of the present invention utilizes a belt and pulley drive mechanism for the ball holder tube which is located alongside and externally thereof, a base that rest on the ground, an enclosure having an inner shell mounted on the base and an outer shell slidably mounted over the inner shell and adjustable to different vertical positions relative to the inner shell and base to adjust the height of an upper end portion of the ball holder tube above the ground, a frame mounting the belt and pulley drive mechanism which, in turn, is supported on the outer shell of the enclosure, and a control mechanism that can be adjusted to selectively operate the drive mechanism in either of an automatic mode and a timed mode in moving the ball holder tube between ball receiving and hitting positions.

Accordingly, the present invention is directed to an automated batting tee apparatus which comprises: (a) a housing having a top opening and opposite upper and lower portions; (b) means for feeding balls one at a time to above the top opening of the housing; (c) an elongated ball holder tube disposed upright in the housing and aligned with the top opening of the housing, the ball holder tube having an upper end portion for receiving a ball from the ball feeding means and a lower end portion spaced below the upper end portion; (d) a drive mechanism arranged upright in the housing externally of and alongside and adjacent to the ball holder tube, the drive mechanism having a pair of upper and lower rotary elements rotatably mounted to the upper and lower portions of the housing and a flexible endless drive element extending over and between the upper and lower rotary elements and movable therewith such that the endless drive element has a pair of lengthwise portions spanning between the upper and lower rotary elements which move in opposite vertical directions relative to one another upon movement of the endless drive element, the ball holder tube being disposed closer to one of the lengthwise portions of the endless drive element than to the other of the lengthwise portions of the endless drive element; (e) a bracket connected to and movably carried by the one lengthwise portion of the endless drive element and extending laterally outward therefrom and connected to the lower end portion of the ball holder tube so as to support the ball holder tube in the upright position aligned with the top opening of the housing and adjacent to and alongside the endless drive element; and (f) drive motion producing means coupled to the lower rotary element of the drive mechanism for reversably rotating the lower rotary element in one or the other of a pair of opposite rotational directions so as to cause opposite vertical movement of the lengthwise portions of the endless drive element in one of downward and upward directions and cause corresponding downward and upward reciprocal movement of the ball holder tube with the one lengthwise portion of the endless drive member relative to the top opening of the housing through a ball receiving and positioning cycle in which as the ball holder tube moves with the closer lengthwise portion of the endless drive element in the downward direction the ball holder tube moves downward through the top opening of the housing and the upper end portion of the ball holder tube is lowered to a ball receiving position across the top opening of the housing for receiving a ball from the ball feeding means and supporting the ball on the upper end of the ball holder tube and then as the ball holder tube moves with the one lengthwise portion of the endless drive element in the upward direction the ball holder tube moves upward through the top opening of the housing and the upper end portion of the ball holder tube with a ball supported thereon is raised to a ball hitting position spaced above the housing.

The present invention also is directed to an automated batting tee apparatus which comprises: (a) a housing which includes (i) a base for resting on the ground, (ii) an enclosure having an inner shell attached at a bottom end on the base and extending upright therefrom to an open top end of the inner shell and an outer shell adapted to removably vertically slidably fit from above over and substantially cover the inner shell and extend from above the open top end of the inner shell downward toward the base, the outer shell having a top wall overlying the open top end of the inner shell and a top opening defined therein, and (iii) an upright frame having an upper portion attached to the top wall of the outer shell and extending downward therefrom in the enclosure such that the upright frame is vertically movable with the outer shell relative to the inner shell; (b) means for feeding balls one at a time to above the top opening of the outer shell of the enclosure; (c) an elongated ball holder tube forming a batting tee disposed upright in the enclosure and aligned with the top opening of the outer shell of the enclosure, the ball holder tube having an upper end portion for receiving a ball from the ball feeding means and a lower end portion spaced below the upper end portion; and (d) drive means in the enclosure mounted on the upright frame for supporting the ball holder tube and causing repetitive reciprocal movements of the ball holder tube in downward and upward directions relative to the top opening of the outer shell of the enclosure so as to move the ball holder tube through a repetitive ball receiving and positioning cycle in which as the ball holder tube is moved in the downward direction the ball holder tube moves downward through the top opening of the outer shell of the enclosure and the upper end of the ball holder tube is lowered to a ball receiving position across the top opening of the top wall of the outer shell of the enclosure for receiving a ball from the ball feeding means and supporting the ball on the upper end portion of the ball holder tube and then as the ball holder tube is moved in the upward direction the ball holder tube moves upward through the top opening of the outer shell of the enclosure and the upper end portion of the ball holder tube with a ball supported thereon is raised to a ball hitting position spaced above the top wall of the outer shell of the enclosure.

The present invention further is directed to an automated batting tee apparatus which comprises: (a) a housing having a top opening and opposite upper and lower portions; (b) means for feeding balls one at a time to above the top opening of the housing; (c) an elongated ball holder tube forming a batting tee disposed upright in the housing and aligned with the top opening of the housing, the ball holder tube having an upper end portion for receiving a ball from the ball feeding means and a lower end portion spaced below the upper end portion; (d) a drive mechanism in the housing for supporting the ball holder tube and being operable to cause repetitive reciprocal movements of the ball holder tube in downward and upward directions relative to the top opening of the housing so as to move the ball holder tube through a repetitive ball receiving and positioning cycle in which as the ball holder tube is moved in the downward direction the ball holder tube moves downward through the top opening of the housing and the upper end of the ball holder tube is lowered to a ball receiving position across the top opening of the housing for receiving a ball from the ball feeding means and supporting the ball on the upper end portion of the ball holder tube and then as the ball holder tube is moved in the upward direction the ball holder tube moves upward through the top opening of the housing and the upper end portion of the ball holder tube with a ball supported thereon is raised to a ball hitting position spaced above the housing; and (e) control means for controlling operation of the drive means and being convertable between first and second conditions to selectively operate the drive mechanism in either an automatic mode and a timed mode in moving the ball holder tube repetitively in the ball receiving and positioning cycle between the ball receiving and hitting positions thereof.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 5 is a cross-sectional view taken along line 5—5 of FIG. 2.

FIG. 6 is an enlarged view of the support frame of the housing of the apparatus of FIG. 3 showing components making up a drive control means of the apparatus.

FIG. 7 is an enlarged view of the support frame of the housing of the apparatus of FIG. 4 showing components of the drive control means of the apparatus.

DETAILED DESCRIPTION OF THE INVENTION

Figure 1:
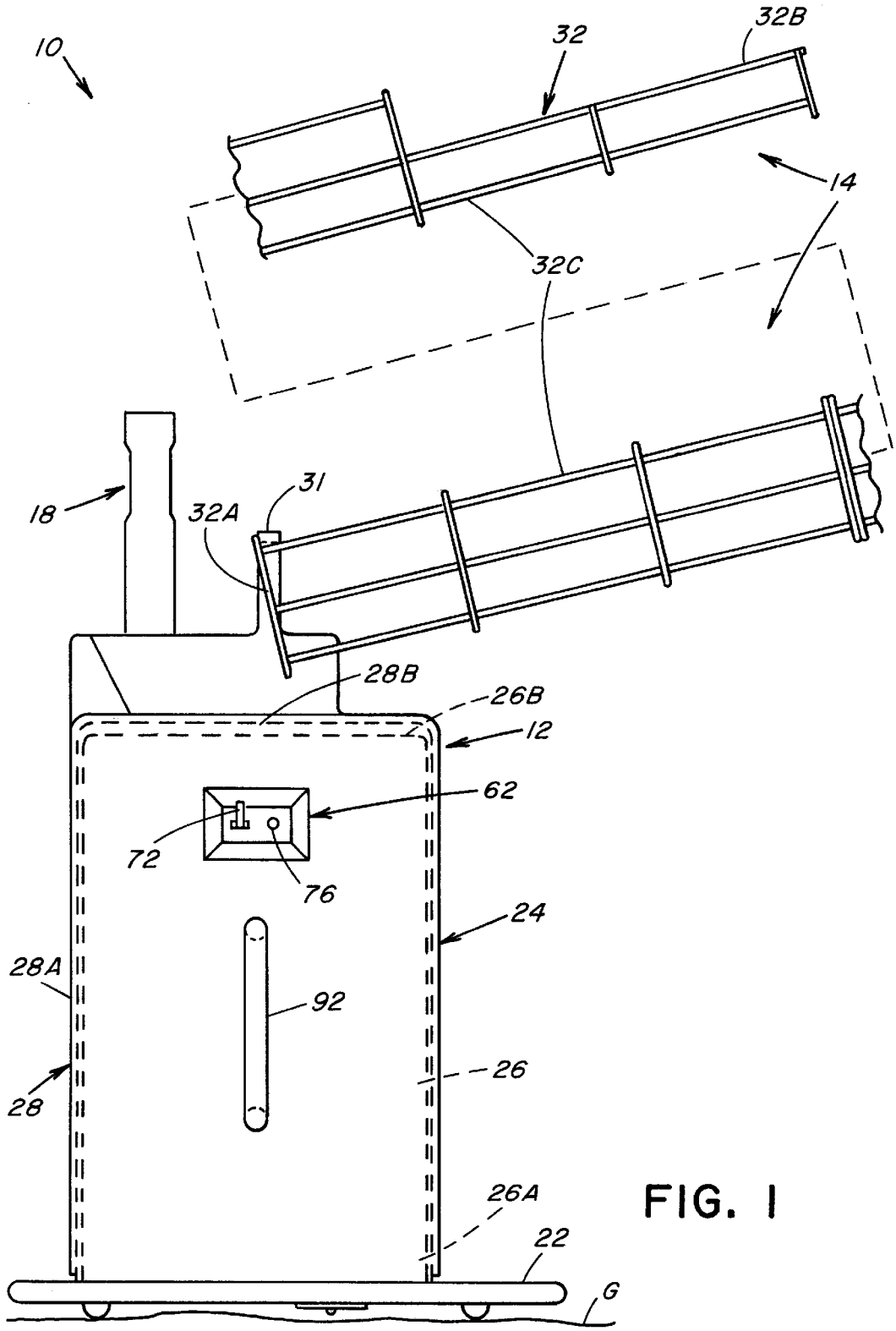
FIG. 1 is a side elevational view of an automatic batting tee apparatus of the present invention with a ball holder tube being shown in a raised ball hitting position.
Figure 2:
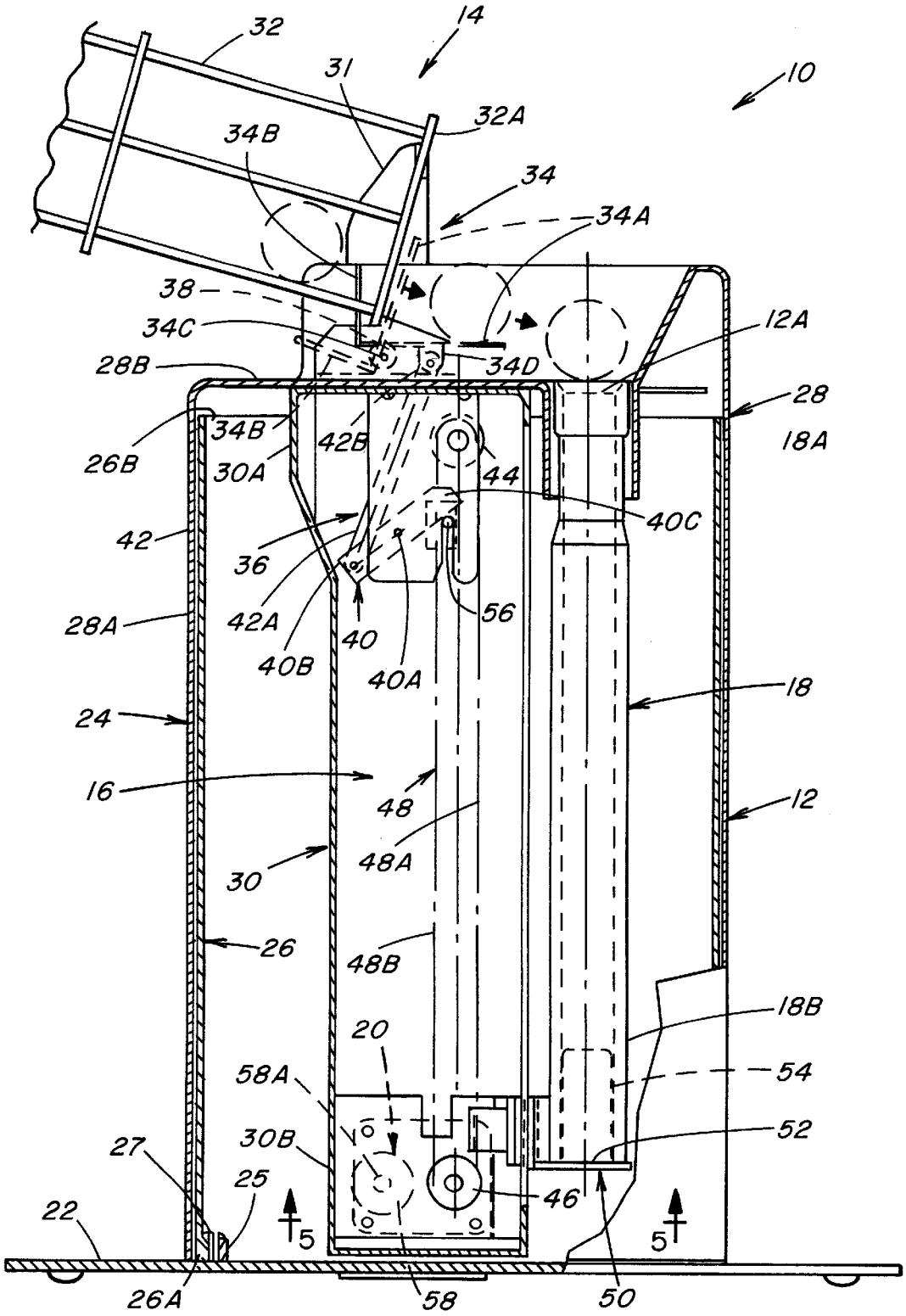
FIG. 2 is a side elevational view of the apparatus rotated one hundred eighty degrees from its orientation in FIG. 1 and with portions of a housing of the apparatus vertically sectioned and broken away to reveal a belt and pulley drive mechanism, a drive motion supplying means, a ball feeding means and the ball holder tube of the apparatus.
Figure 4:
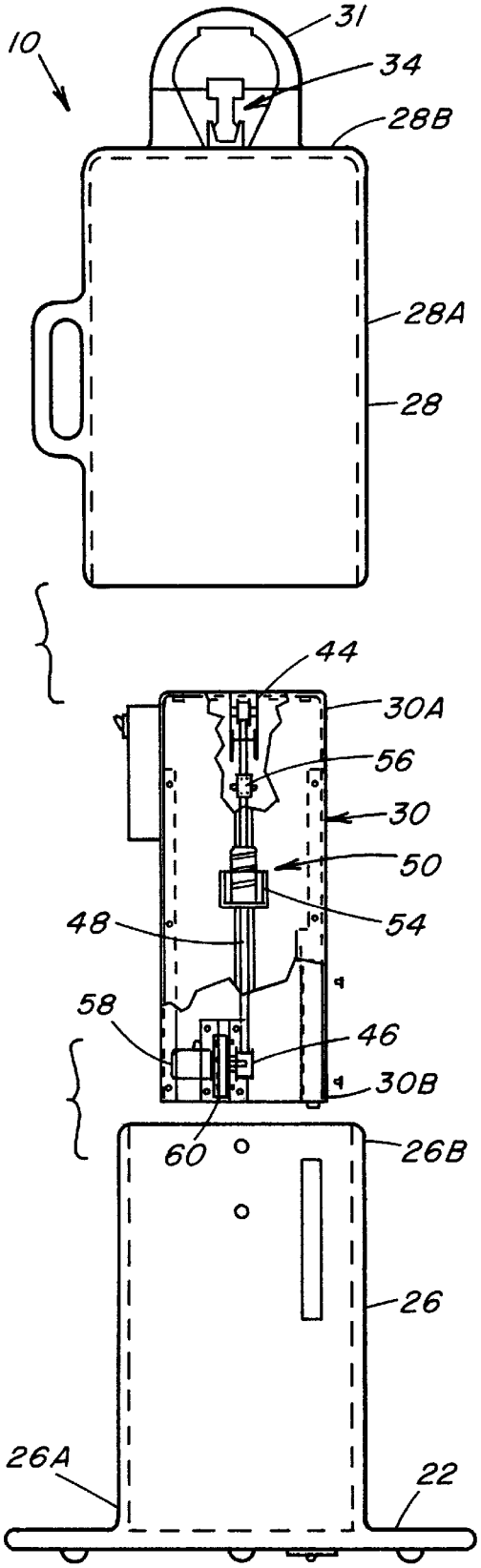
FIG. 4 is another side elevational view of the apparatus similar to that of FIG. 3 but rotated ninety degrees from its orientation in FIG. 3.
Figure 3:
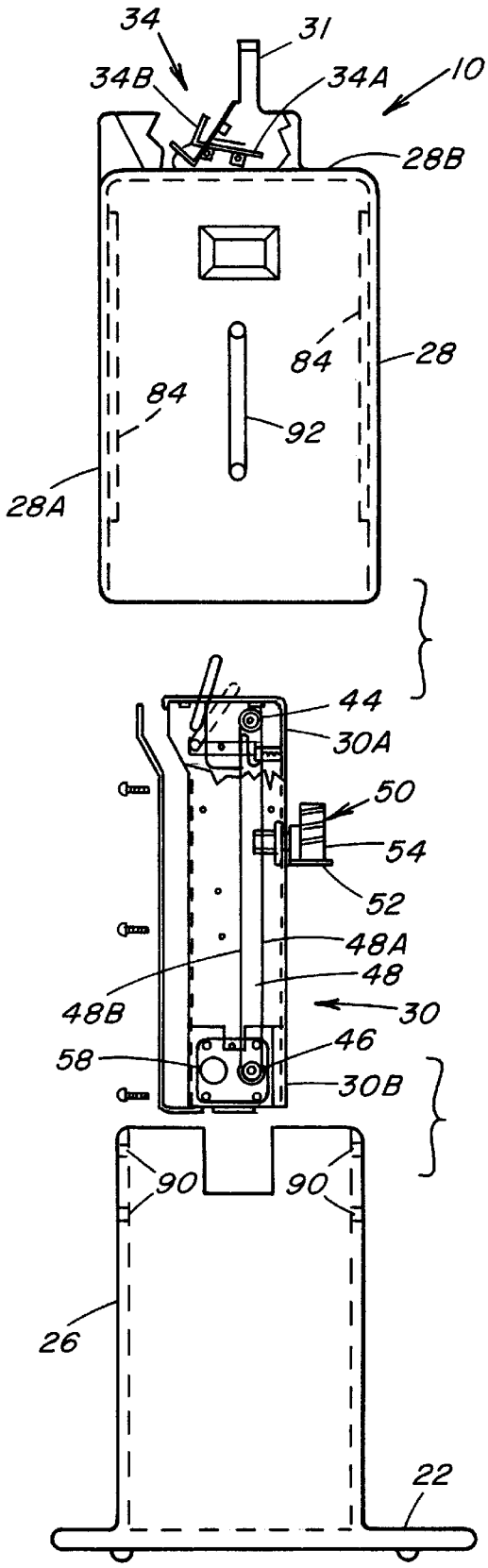
FIG. 3 is a side elevational view of the apparatus of FIG. 2, on a reduced scale, with outer and inner shells and an upright support frame of the housing of the apparatus shown in exploded form and with the ball holder tube omitted.
Figure 8:
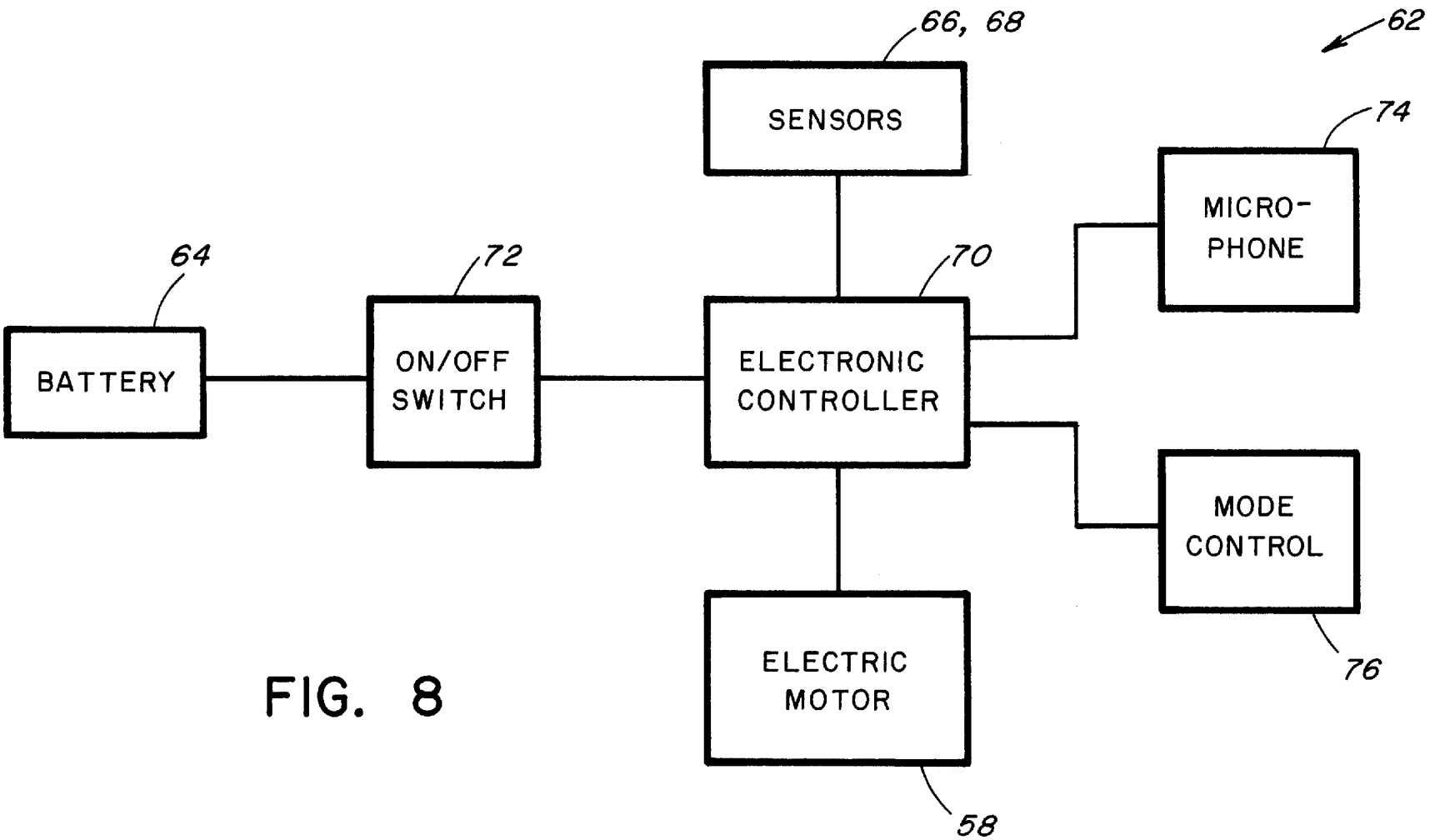
FIG. 8 is a block diagram of the drive control means of the apparatus which can be adjusted to selectively operate the drive mechanism in either an automatic mode or a timed mode in moving the ball holder tube between ball receiving and hitting positions of the apparatus.

Referring to the drawings and particularly to FIGS. 1 and 2, there is illustrated an automated batting tee apparatus of the present invention, generally designated 10. The automated batting tee apparatus 10 basically includes a housing 12, a ball feeding means 14, a drive mechanism 16, a ball holder tube 18 forming a batting tee, and a drive motion producing means 20.

Figure 11:
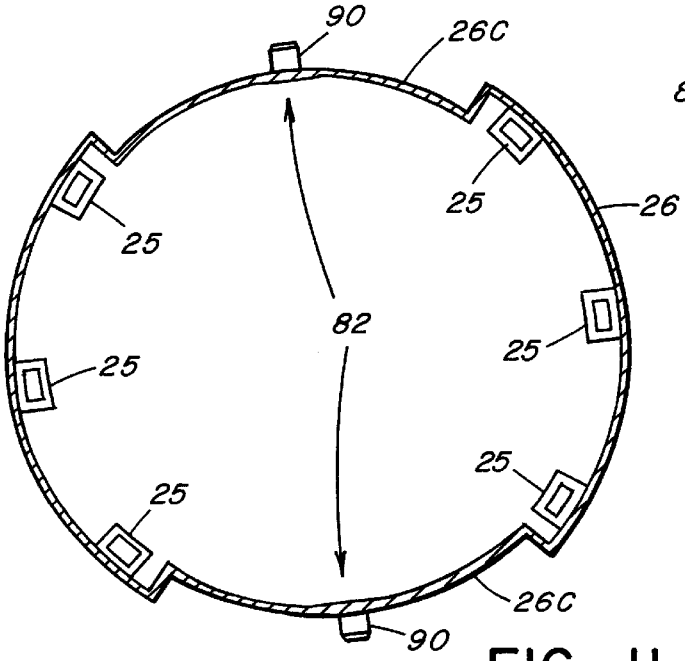
FIG. 11 is an enlarged cross-sectional view of the inner shell of the housing showing pins of the batting tee height adjustment means disposed on opposite side portions of the inner shell.

Referring to FIGS. 1 to 4, the housing 12 of the apparatus 10 includes a flat base 22 adapted to rest on the ground. G and an enclosure 24 mounted on the base 22 and supported thereon in a stabilized fashion. The enclosure 24 extends upright from the base 22 and has a top opening 12A of the housing 12 defined therein. The enclosure 24 of the housing 12 includes an inner shell 26 attached at a bottom end 26A on the base 22 by the interengagement of pairs of complementary snap-fit elements 25, 27 respectively thereon, as seen in FIGS. 2 and 11. The inner shell 26 extends upright therefrom to an open top end 26B of the inner shell 26. The enclosure 24 also includes an outer shell 28 having a sidewall 28A and a top wall 28B adapted to removably slidable fit over and substantially cover the inner shell 26 and extend from above the open top end 26B of the inner shell 26 downward toward the base 22 and bottom end 26A of the inner shell 26. The top wall 28B of the outer shell 28 has the top opening 12A of the housing 12 defined therein. The housing 12 further includes a rigid support frame 30 having an upper portion 30A attached to the top wall 28B of the outer shell 28 and extending downward therefrom in the enclosure 24 such that the upright frame 30 is supported solely by the outer shell 28 and is vertically movable with the outer shell 28 relative to the inner shell 26 toward and away from the base 22. The housing 12 further includes an inverted U-shaped holder 31 rigidly attached on and extending upwardly from the top wall 28B of the outer shell 28 of the enclosure 24.

The ball feeding means 14 of the apparatus 10 includes a ball feeder chute 32, a ball dispensing mechanism 34, an actuating linkage 36 and a biasing element 38. The ball feeder chute 32 interengages at a discharge end 32A thereof under the inverted U-shaped holder 31 of the housing 12 so as to mount to the top wall 28B of the outer shell 28 of the housing enclosure 24 and extends inclined outwardly and upwardly therefrom in a cantilevered fashion to an infeed end 32B of the chute 32. The infeed end 32B and discharge end 32A of the chute 32 are interconnected by an elongated ball transfer portion 32C of the chute 32 for guiding balls, such as baseballs or softballs, in a row from the infeed end 32B to the discharge end 32A of the chute 32. The discharge end 32A of the chute 32 is located adjacent to the top opening 12A of the housing 12.

The ball dispensing mechanism 34 is a generally L-shaped structure made up of a long leg portion 34A and a short leg portion 34B with the long leg portion 34A being pivotally mounted at 34C to the discharge end 32A of the chute 32. The ball dispensing mechanism 34 undergoes pivotal movement between a ball blocking position, as shown in dashed line form in FIG. 2, and a ball releasing position, as seen in solid line form in FIG. 2, so as to permit the discharge of only one ball at a time from the chute 32 to above the top opening 12A of the housing 12 during each ball receiving and positioning cycle. In the upright ball blocking position, the longer leg 32A blocks the path of the row of balls in the chute 32, whereas in the depressed ball releasing position the longer leg 34A unblocks the path of the balls while the shorter leg 34B temporarily blocks all of the balls except the leading one allowing the latter to roll onto and down the top wall of the enclosure 24 to the top opening 12A of the housing 12.

The actuating linkage 36 intercouples the ball dispensing mechanism 34 to the drive mechanism 16 such that the ball dispensing mechanism 34 is actuated from the ball blocking position to the ball releasing position in response to the drive mechanism 16 moving the ball holder tube 18 so as to reach the ball receiving position, shown in FIG. 2. The actuating linkage 36 has a lower link 40 pivotally mounted at 40A between its opposite ends 40B, 40C to the support frame 30, and an upper link 42 at one end 42A being pivotally connected to the one end 40B of the lower link 40 and at the other end 42B to a tab 34C on the longer leg 34A of the ball dispensing mechanism 34. The biasing element 38 is a coil spring attached to and extending between the shorter leg 34B of the dispensing mechanism 34 and the top wall of the outer shell of the enclosure so as to impose a biasing force thereon which causes the dispensing mechanism 34 to return to its upright ball blocking position after the discharge of only one ball at a time from the chute 32 and in response to the drive mechanism 16 moving the ball holder tube 18 away from the ball receiving position during each ball receiving and positioning cycle of the apparatus 10.

The actuating linkage 36 intercouples the ball dispensing mechanism 34 to the drive mechanism 16 such that the ball dispensing mechanism 34 is actuated from the ball blocking position to the ball releasing position in response to the drive mechanism 16 moving the ball holder tube 18 so as to reach the ball receiving position, shown in FIG. 2. The actuating linkage 36 has a lower link 40 pivotally mounted at 40A between its opposite ends 40B, 40C to the support frame 30, and an upper link 42 at one end 42A being pivotally connected to the one end 40B of the lower link 40 and at the other end 42B to a tab 34D on the longer leg 34A of the ball dispensing mechanism 34. The biasing element 38 is a coil spring attached to and extending between the shorter leg 34B of the dispensing mechanism 34 and the top wall of the outer shell of the enclosure so as to impose a biasing force thereon which causes the dispensing mechanism 34 to return to its upright ball blocking position after the discharge of only one ball at a time from the chute 32 and in response to the drive mechanism 16 moving the ball holder tube 18 away from the ball receiving position during each ball receiving and positioning cycle of the apparatus 10.

As seen particularly in FIGS. 2, 4, 5 and 7, the drive mechanism 16 also includes a bracket 50, being formed by a shuttle seat 52 which is connected to and movably carried by the one lengthwise portions 48A of the endless drive belt 48 and extends laterally outward therefrom and a threaded mounting boss 54 attached on the seat 52 and receiving and connected to the lower end portion 18B of the ball holder tube 18 so as to support the ball holder tube 18 in the upright position aligned with the top opening 12A of the housing 12 and adjacent to and alongside the endless drive belt 48. The frame 30 of the housing 12 is offset laterally of the top opening 14 of the housing 12 and has a side wall portion 30C extending between upper and lower portions 30A, 30B of the frame 30 and a longitudinal slot 55 defined in the side wall portion 30C such that the belt 48 and ball holder tube 18 are generally aligned with one another through the longitudinal slot 55 and disposed respectively inside and outside, or along opposite sides, of the frame 30. The shuttle seat 52 of the bracket 50, which is supported and carried only on the one lengthwise portion 48A of the belt 48 located inside of the frame 30, laterally extends through the slot 55 from the one belt lengthwise portion 48A to beyond or outside of the side wall portion 30C of the frame 30 to where the ball holder tube 18 is supported only on the shuttle seat 52 so as to extend along the outside of the frame 30 and in alignment with the top opening 14 of the housing 12. The ball holder tube 18 at the lower end portion 18B thereof is threadably seated on and removed from the threaded mounting boss 54 of the bracket 50 by turning the ball holder tube 18 in respective opposite directions. The other lengthwise portion 48B of the endless drive belt 48 has a block 56 attached thereon which engages and pivots (counterclockwise as seen in FIG. 2) the other end 40C of the lower link 40 of the actuating linkage 34 for actuating the ball dispensing mechanism 34 from the ball blocking position to the ball releasing position, as shown in solid line form in FIG. 2, upon the ball holder tube 18 reaching the lower ball receiving position.

The drive motion producing means 20 of the apparatus 10 is coupled to the drive mechanism 16 for reversably moving the drive mechanism 16 in one or the other of a pair of opposite vertical directions so as to cause corresponding downward and upward reciprocal movement of the ball holder tube 18 relative to the top opening 12A of the housing 12. Through a single ball receiving and positioning cycle, the ball holder tube 18 is moved in the downward direction through the top opening 12A of the housing 12 such that the upper end portion 18A of the ball holder tube 18 is lowered to a ball receiving position, as seen in FIG. 2, in which it extends across the top opening 12A of the housing 12 for receiving a ball from the ball feeding means 14 and supporting the ball on the upper end portion 18A of the ball holder tube 18. Then, once the ball is supported thereon, the ball holder tube 18 is moved in the upward direction through the top opening 12A of the housing 12 such that the upper end portion 18A of the ball holder tube 18 with a ball supported thereon is raised to a ball hitting position, as seen in FIG. 1, spaced above the housing 12.

More particularly, referring to FIGS. 2 to 5, the drive motion producing means 20 includes an electric motor 58 and a drive motion transmission arrangement 60. The electric motor 58 is mounted to the frame 30 and has a rotary drive shaft 58A. The drive motion transmission arrangement 60 is drivingly coupled between the rotary drive shaft 58A of the electric motor 58 and the lower pulley 46 of the drive mechanism 16 such that rotation of the rotary drive shaft 58A of the electric motor 58 causes rotation of the lower pulley 46 and thereby movement of the endless drive belt 48 of the drive mechanism 16 and the ball holder tube 18 therewith between the ball receiving and hitting positions.

Referring to FIGS. 1 and 5 to 8, the apparatus 10 also includes drive control means 62 provided to control operation of the electric motor 58 and thereby operation of the drive mechanism 16 in moving the ball holder tube 18 repetitively in the ball receiving and positioning cycle between the ball receiving position of FIG. 2 and the hitting position of FIG. 1. The drive control means 62 also is convertable between first and second conditions to selectively operate the electric motor 58 in either one of an automatic mode and a timed mode in moving the ball holder tube 18 repetitively in the ball receiving and positioning cycle between the ball receiving and hitting positions. More particularly, the drive control means 62 includes an electrical power source preferably in the form of a rechargeable battery 64, upper and lower sensors 66, 68, an electronic controller 70, an on/off switch 72, a microphone 74 and a mode control device 76. The battery 64 is disposed in the enclosure 24 and removable therefrom through the base 22 of the housing 12. The battery 64 via the on/off switch 72 is connected to the electric motor 58 and the upper and lower sensors 66, 68. The upper and lower sensors 66, 68 are respectively mounted to the upper and lower portions 30A, 30B of the frame 30 for detecting arrival of the ball holder tube 18 at corresponding ball receiving and hitting positions of the ball receiving and positioning cycle and in response thereto for producing electrical signals. The electronic controller 70 is connected to the electric motor 58 and the upper and lower sensors 66, 68 for receiving the electrical signals from the sensors 66, 68 and in response thereto for controlling the operation of the electric motor 58. The microphone 74 and the mode control device 76 are separately connected to the electronic controller 70. The electronic controller 70, on/off switch 72, microphone 74 and mode control device 76 are provided on a printed circuit board 78 supported at a side of the upper portion 30A of the frame 30, as seen in FIGS. 6 and 7. The upper and lower sensors 66, 68 preferably are electro-optical sensors positioned adjacent to the endless drive belt 48 of the drive mechanism 16. A flag element 80 is attached on the bracket 50, as seen in FIG. 5, intersects and blocks the transmission of a light beam between the respective electro-optical sensors 66, 68 which, in turn, signals the electronic controller 70 to control the operation of the electric motor 58 depending upon which mode of operation has been selected by the user via the mode control device 76. The electronic controller 70 is pre-programmed in a manner conventionally practiced by those skilled in software and programming arts to control the operation of the electric motor 58 in response to inputs received from upper and lower sensors 66, 68, the microphone 74 and the mode control device 76.

The on/off switch 72 is not only employed to turn the apparatus 10 on or off but also is manipulated by the user between first and second positions to convert the electronic controller 70 between the first and second conditions and thereby selectively operate the electric motor 58 in one or the other of the automatic and timed modes. The drive mechanism 16 is placed in the automatic mode in response to the switch 72 being moved to the first position and the electronic controller 70 converted to the first condition. In the automatic mode, the drive mechanism 16 is operated to cause the ball holder tube 18 to move through the ball receiving and positioning cycle between the ball receiving and hitting positions thereof in response to the microphone 74 detecting a sufficiently loud sound such as made when a ball on the upper end portion 18A of the ball holder tube 18 is hit by the batter. The drive mechanism 16 is placed in the timed mode in response to the switch 72 being moved to the second position and the electronic controller 70 converted to second condition. In the timed mode, the drive mechanism 16 is operated to cause the ball holder tube 18 to move through the ball receiving and positioning cycle between the ball receiving and hitting positions thereof after the ball holder tube 18 has paused and held a ball on the upper end portion 18A of the ball holder tube 18 in the ball hitting position for a preselected period of time. The mode control device 76 is an adjustment knob which is used to set the cycle time for the timer mode and the volume sensitivity of the auto mode. In the timer mode, when the adjustment knob is turned all the way to the right or left, the pause between cycles correspondingly becomes shorter or longer such that the speed of the cycle thereby will be faster or slower. In the auto mode, the adjustment knob enables the batter to control premature cycling of the ball holder tube 18. Since the cycling of the ball holder tube 18 is activated by sound, it is possible for it to cycle on its own due to loud background noise and not the actual ball contact by the batter. When the adjustment knob is turned all the way to the right, it is the most sensitive and can be triggered by the clap of the user's hands. When turned all the way to the left, it is insensitive to most noises except the hitting of the ball by the batter.

Figure 10:
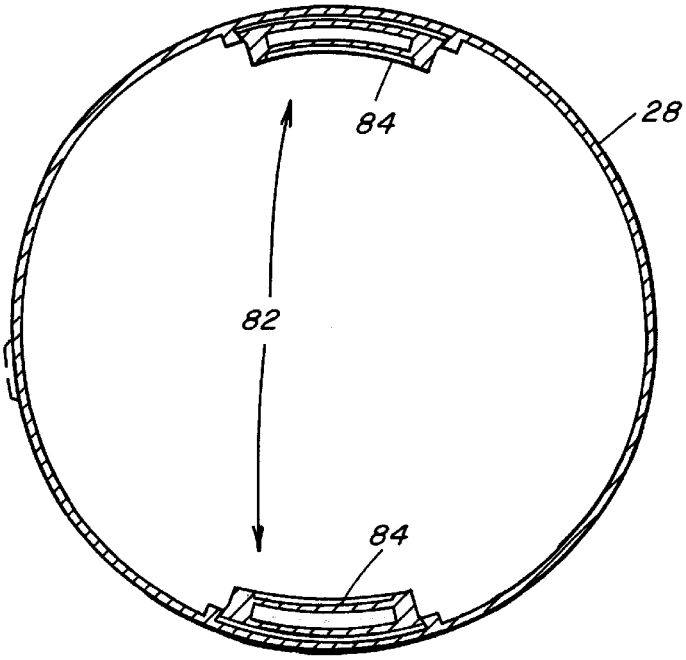
FIG. 10 is an enlarged cross-sectional view of the outer shell of the housing showing a pair of wall segments of the batting tee height adjustment means thereon.
Figure 9:
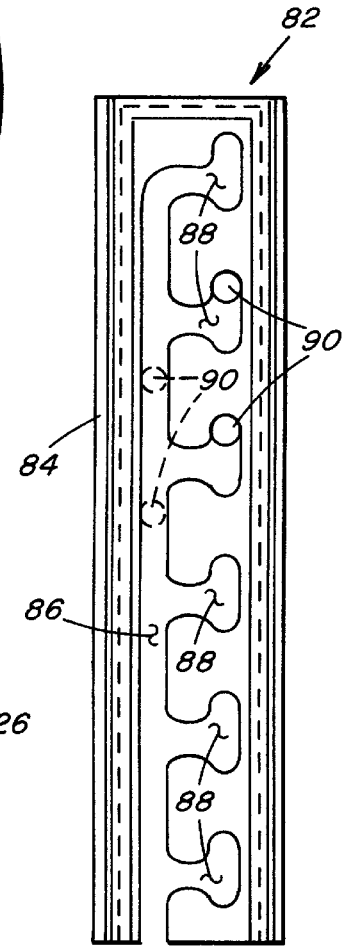
FIG. 9 is an enlarged fragmentary view of batting tee height adjustment means on the inner and outer shells of the housing of the apparatus as seen along line 9—9 of FIG. 1.

Referring to FIGS. 9 to 11, the apparatus 10 further includes batting tee height adjustment means, generally designated 82, on the inner and outer shells 26, 28 of the housing 12 of the apparatus 10. The batting tee height adjustment means 82 includes opposite wall segments 84 on the interior of the outer shell 28 of the enclosure 24 facing toward one another and extending between upper and lower ends of the enclosure 24. Each of the wall segments 84 has a main track 86 defined thereon and a plurality of vertically spaced branch tracks 88 defined thereon so as to merge from and extend generally transversely to the main track 86 at different positions spaced vertically from one another. Each branch track 88 has a generally L-shaped configuration. The batting tee height adjustment means 82 further includes pairs of pins 90 mounted on and protruding exteriorly from inwardly recessed opposite portions 26C of the inner shell 26 of the enclosure 24 toward the corresponding wall segment 82 on the outer shell 28. The pins 90 are slidable along the main track 86 of the respective wall segment 84 by raising or lowering the outer shell 28 relative to the inner shell 26 and placeable in a selected one of the branch tracks 88 by rotating the outer shell 28 relative to the inner shell 26 to position the upper shell 28 in a selected one of a plurality of vertical positions along and relative to the inner shell 26 and thereby place the upper end portion 18A of the ball holder tube 18 at a selected one of a plurality of heights above the ground. By way of example, there are five different height positions between thirty-two and forty-four inches above the ground. In adjusting the height of the ball holder tube 18, light pressure is applied by the user's foot upon a flat portion of the base 22 to keep the entire base from rotating while making the height adjustment. The rack holder may be grasped for slightly rotating and pulling the outer shell 28 relative to the lower shell 26 and in a vertical direction. The apparatus 10 also includes a handle 92 attached to a side of the outer shell 28 for use in carrying the apparatus 10.

It is thought that the present invention will be understood from the foregoing description and it will be apparent that various changes may be made thereto without departing from the spirit and scope of the invention or sacrificing all of its material advantages, the form hereinbefore described being merely an exemplary embodiment.

We claim:

1. An automated batting tee apparatus, comprising:

(a) a housing having an enclosure with a top opening and an upright frame supported and extending upright in said enclosure in a laterally offset relation to said top opening of said enclosure and having opposite upper and lower portions;

(b) means for feeding balls one at a time to above said top opening of said housing;

(c) an elongated ball holder tube forming a batting tee disposed upright in said housing and aligned with said top opening of said housing, said ball holder tube having an upper end portion for receiving a ball from said ball feeding means and a lower end portion spaced below said upper end portion;

(d) a drive mechanism arranged upright in said housing externally of and alongside and adjacent to said ball holder tube and operatively mounted to and extending between said upper and lower portions of said upright frame, said drive mechanism having a pair of upper and lower rotary elements respectively rotatably mounted to said upper and lower portions of said upright frame and a flexible endless drive element extending over and between said upper and lower rotary elements and movable therewith such that said endless drive element has a pair of lengthwise portions spanning between said upper and lower rotary elements which move in opposite vertical directions relative to one another upon movement of said endless drive element, said ball holder tube being located closer to one of said lengthwise portions of said endless drive element than to the other of said lengthwise portions of said endless drive element;

(e) a bracket supported and movably carried only by said one lengthwise portion of said endless drive element of said drive mechanism and extending laterally outward therefrom to where said ball holder tube at said lower end portion thereof is supported only on said bracket in said upright position aligned with said top opening of said housing and adjacent to and alongside said endless drive element; and (f) drive motion providing means coupled to said lower rotary element of said drive mechanism for reversably rotating said lower rotary element in one or the other of a pair of opposite rotational directions so as to cause opposite vertical movements of said lengthwise portions of said endless drive element in one or the other of downward and upward directions and cause corresponding downward and upward reciprocal movement of said ball holder tube with said one lengthwise portion of said endless drive element relative to said top opening of said housing through a ball receiving and positioning cycle in which as said ball holder tube moves with said one lengthwise portion of said endless drive element in the downward direction said ball holder tube moves downward through said top opening of said housing and said upper end portion of said ball holder tube is lowered to a ball receiving position across said top opening of said housing for receiving a ball from said ball feeding means and supporting the ball on said upper end of said ball holder tube and then as said ball holder tube moves with said one lengthwise portion of said endless drive element in the upward direction said ball holder tube moves upward through said top opening of said housing and said upper end portion of said ball holder tube with a ball supported thereon is raised to a ball hitting position spaced above said housing.

2. The apparatus of claim 1 wherein said upper and lower rotary elements of said drive mechanism are upper and lower pulleys rotatably mounted to said upper and lower portions of said upright frame and said flexible endless drive element is a flexible belt extending over and between said upper and lower pulleys and movable therewith such that said endless drive belt has said lengthwise portions spanning between said upper and lower pulleys which move in opposite vertical directions relative to one another upon movement of said endless drive belt.

3. The apparatus of claim 2 wherein said drive motion providing means is coupled to said lower pulley of said drive mechanism for reversably rotating said lower pulley in one or the other of a pair of opposite rotational directions so as to cause opposite vertical movement of said lengthwise portions of said endless drive belt in one or the other of downward and upward directions.

4. The apparatus of claim 1 wherein said housing includes a base resting on the ground, said enclosure being mounted on said base and extending upright therefrom.

5. The apparatus of claim 1 wherein said upright frame also includes a side wall portion extending between and interconnecting said upper and lower portions of said upright frame and having a longitudinal slot defined therein, said ball holder tube being disposed along one side of said side wall portion of said frame and extending along said longitudinal slot of said frame, said endless drive element of said drive mechanism being disposed along another side of said side wall portion of said frame opposite to said one side thereof and extending along said longitudinal slot of said side wall portion of said frame such that said ball holder tube and said endless drive element of said drive mechanism are generally aligned with one another through said longitudinal slot of said side wall portion of said frame, said bracket extending laterally outward from said endless drive element through said longitudinal slot of and beyond said side wall portion of said upright frame to said ball holder tube such that said side wall portion of said frame is disposed between said endless drive element and said ball holder tube.

6. The apparatus of claim 5 wherein said drive motion providing means includes:

an electric motor mounted to said upright frame and having a rotary drive shaft; and a drive motion transmission arrangement drivingly coupling said rotary drive shaft of said electric motor to said lower rotary element of said drive mechanism such that rotation of said rotary drive shaft of said electric motor causes rotation of said lower rotary element of said drive mechanism.

7. The apparatus of claim 6 further comprising:

control means for controlling the operation of said electric motor and thereby operation of said drive mechanism in moving said ball holder tube between said respective ball receiving and hitting positions of said ball receiving and positioning cycle.

8. The apparatus of claim 7 wherein said control means includes:

a battery disposed in said enclosure and removable therefrom through said base and being connected to said electric motor;

a pair of sensors each connected to said battery and mounted to one of said lower and upper portions of said frame for detecting arrival of said ball holder tube at one of said respective ball receiving and hitting positions of said ball receiving and positioning cycle and in response thereto capable of producing an electrical signal; and a controller connected to said electric motor and said sensors for receiving said electrical signals from said sensors and in response thereto controlling the operation of said electric motor.

9. The apparatus of claim 4 wherein said enclosure includes:

an inner shell attached at a bottom end on said base and extending upright therefrom to an open top end of said inner shell; and an outer shell adapted to removably slidably fit over and substantially cover said inner shell and extend from above said open top end of said inner shell downward toward said base.

10. The apparatus of claim 9 wherein said outer shell includes a top wall with said top opening of said housing defined therein.

11. The apparatus of claim 10 wherein said ball feeding means includes a ball feeder chute mounted to said top wall of said outer shell of said housing and extending inclined outwardly and upwardly therefrom, said chute having a discharge end located adjacent to said top opening in said top wall of said outer shell.

12. The apparatus of claim 1 wherein said ball feeding means includes a ball dispensing mechanism pivotally mounted adjacent to said top opening of said housing for undergoing movement between a ball blocking position and a ball releasing position so as to permit discharge of only one ball at a time to above said top opening of said housing during each ball receiving and positioning cycle.

13. The apparatus of claim 12 wherein said ball feeding means further includes an actuating linkage intercoupling said ball dispensing mechanism to said other lengthwise portion of the endless drive element of said drive mechanism such that said ball dispensing mechanism is actuated from said ball blocking position to said ball releasing position in response to said endless drive element moving said ball holder tube away from said ball receiving position.

14. The apparatus of claim 13 wherein said ball feeding means further includes an element biasing said ball dispensing mechanism to assume said ball blocking position in response to said endless drive element of said drive mechanism moving said ball holder so as to leave said ball receiving position.

15. The apparatus of claim 1 wherein:

said bracket has a threaded element supported thereon; and said ball holder tube at said lower end portion thereof can be threadably seated on and removed from said threaded element of said bracket by turning said ball holder tube in respective opposite directions.

16. An automated batting tee apparatus, comprising:

(a) a housing including (i) a base for resting on the ground, (ii) an enclosure having an inner shell attached at a bottom end on said base and extending upright therefrom to an open top end of said inner shell and an outer shell fitted over and substantially covering said inner shell and extending from above said open top end of said inner shell downward toward said base, said outer shell having a top wall overlying said open top end of said inner shell and a top opening defined therein, said outer shell adapted to be slidably moved upwardly relative to said inner shell to remove said outer shell from over said inner shell, and (iii) an upright frame having an upper portion attached to said top wall of said outer shell and extending downward therefrom in said enclosure and a lower portion spaced inwardly from said inner shell and above said base such that said upright frame is only attached at said upper portion thereof to said top wall of said outer shell and thus is vertically movable with said outer shell relative to said inner shell;

(b) means for feeding balls one at a time to above said top opening of said outer shell of said enclosure;

(c) an elongated ball holder tube forming a batting tee disposed upright in said enclosure and aligned with said top opening of said outer shell of said enclosure, said ball holder tube having an upper end portion for receiving a ball from said ball feeding means and a lower end portion spaced below said upper end portion; and (d) means in said enclosure mounted on said upright frame for supporting said ball holder tube and causing repetitive reciprocal movements of said ball holder tube in downward and upward directions relative to said top opening of said outer shell of said enclosure so as to move said ball holder tube through a repetitive ball receiving and positioning cycle in which as said ball holder tube is moved in the downward direction said ball holder tube moves downward through said top opening of said outer shell of said enclosure and said upper end of said ball holder tube is lowered to a ball receiving position across said top opening of said top wall of said outer shell of said enclosure for receiving a ball from said ball feeding means and supporting the ball on said upper end portion of said ball holder tube and then as said ball holder tube is moved in the upward direction said ball holder tube moves upward through said top opening of said outer shell of said enclosure and said upper end portion of said ball holder tube with a ball supported thereon is raised to a ball hitting position spaced above said top wall of said outer shell of said enclosure.

17. An automated batting tee apparatus, comprising:

(a) a housing including (i) a base for resting on the ground, (ii) an enclosure having an inner shell attached at a bottom end on said base and extending upright therefrom to an open top end of said inner shell and an outer shell fitted over and substantially covering said inner shell and extending from above said open top end of said inner shell downward toward said base, said outer shell having a top wall overlying said open top end of said inner shell and a top opening defined therein, said outer shell adapted to be slidably moved upwardly relative to said inner shell to remove said outer shell from over said inner shell, and (iii) an upright frame having an upper portion attached to said top wall of said outer shell and extending downward therefrom in said enclosure such that said upright frame is vertically movable with said outer shell relative to said inner shell;

(b) means for feeding balls one at a time to above said top opening of said outer shell of said enclosure;

(c) an elongated ball holder tube forming a batting tee disposed upright in said enclosure and aligned with said top opening of said outer shell of said enclosure, said ball holder tube having an upper end portion for receiving a ball from said ball feeding means and a lower end portion spaced below said upper end portion;

(d) means in said enclosure mounted on said upright frame for supporting said ball holder tube and causing repetitive reciprocal movements of said ball holder tube in downward and upward directions relative to said top opening of said outer shell of said enclosure so as to move said ball holder tube through a repetitive ball receiving and positioning cycle in which as said ball holder tube is moved in the downward direction said ball holder tube moves downward through said top opening of said outer shell of said enclosure and said upper end of said ball holder tube is lowered to a ball receiving position across said top opening of said top wall of said outer shell of said enclosure for receiving a ball from said ball feeding means and supporting the ball on said upper end portion of said ball holder tube and then as said ball holder tube is moved in the upward direction said ball holder tube moves upward through said top opening of said outer shell of said enclosure and said upper end portion of said ball holder tube with a ball supported thereon is raised to a ball hitting position spaced above said top wall of said outer shell of said enclosure; and (e) batting tee height adjustment means on said inner and outer shells of said enclosure for adjustably changing the vertical position of said outer shell along and relative to said inner shell to thereby change the height of said upper end portion of said ball holder tube above the ground.

18. The apparatus of claim 17 wherein said batting tee height adjustment means includes:

at least one wall segment on one of said inner and outer shells of said enclosure facing toward the other of said inner and outer shells and extending between upper and lower ends of said enclosure, said wall segment having a main track defined thereon and a plurality of vertically spaced branch tracks defined thereon so as to merge from and extend generally transversely to said main track at different positions spaced vertically from one another; and at least one pin on the other of said inner and outer shells of said enclosure protruding toward said at least one wall segment on the one of said inner and outer shells and slidable along said main track of said wall segment by raising or lowering said outer shell relative to said inner shell and placeable in a selected one of said branch tracks by rotating said outer shell relative to said inner shell to position said upper shell in a selected one of a plurality of vertical positions along and relative to said inner shell and thereby place said upper end portion of said ball holder tube at a selected one of a plurality of heights above the ground.

19. The apparatus of claim 18 wherein:

said at least one wall segment is a pair of said wall segments each disposed on one of opposite interior side portions of said outer shell; and said at least one pin is a pair of pins disposed on each of opposite exterior side portions of said inner shell which are adjacent to said opposite interior side portions of said outer shell.

20. The apparatus of claim 18 wherein each of said branch tracks has a generally L-shaped configuration.

21. The apparatus of claim 16 wherein said ball feeding means includes a ball feeder chute mounted to said top wall of said outer shell of said enclosure and extending inclined outwardly and upwardly therefrom, said chute having a discharge end located adjacent to said top opening in said top wall of said outer shell.

22. The apparatus of claim 21 wherein said ball feeding means further includes a ball dispensing mechanism pivotally mounted adjacent to said top opening of said top wall of said outer shell of said enclosure for undergoing movement between a ball blocking position and a ball releasing position so as to permit discharge of only one ball at a time to above said top opening of said top wall of said outer shell during each ball receiving and positioning cycle.

23. The apparatus of claim 22 wherein said ball feeding means further includes an actuating linkage intercoupling said ball dispensing mechanism to said drive means through said top wall of said outer shell of said enclosure such that said ball dispensing mechanism is actuated from said ball blocking position to said ball releasing position in response to said drive means moving said ball holder tube to said ball receiving position.

24. The apparatus of claim 1 further comprising:

control means for controlling operation of said drive motion providing means and being convertable between first and second conditions to selectively operate said drive mechanism in either an automatic mode or a timed mode in moving said ball holder tube repetitively in said ball receiving and positioning cycle between said ball receiving and hitting positions thereof.

25. The apparatus of claim 24 wherein said control means has a switch movable between first and second positions to convert said control means between said first and second conditions and thereby to selectively operate said drive mechanism in either of said automatic mode and said timed mode.

26. The apparatus of claim 24 wherein said drive mechanism is placed in said automatic mode in response to said control means being converted to said first condition and said drive mechanism is operable to cause said ball holder tube to move through said ball receiving and positioning cycle between said ball receiving and hitting positions thereof in response to a ball on said upper end portion of said ball holder tube being hit by the batter.

27. The apparatus of claim 24 wherein said drive mechanism is placed in said timed mode in response to said control means being converted to said second condition and said drive mechanism is operable to cause said ball holder tube to move through said ball receiving and positioning cycle between said ball receiving and hitting positions thereof after said ball holder tube has paused and held a ball on said upper end portion of said ball holder tube in said ball hitting position for a preselected period of time.

28. The apparatus of claim 1 further comprising:

control means for controlling operation of said drive mechanism in an automatic mode to move said ball holder tube repetitively in said ball receiving and positioning cycle between said ball receiving and hitting positions thereof, said drive mechanism being placed in said automatic mode in response to said control means being adjusted to said first condition and said drive mechanism being operable to cause said ball holder tube to move through said ball receiving and positioning cycle between said ball receiving and hitting positions thereof in response to a ball on said upper end portion of said ball holder tube being hit by the batter.

29. The apparatus of claim 1 further comprising: control means for controlling operation of said drive mechanism to selectively operate said drive mechanism in a timed mode in moving said ball holder tube repetitively in said ball receiving and positioning cycle between said ball receiving and hitting positions thereof, said drive mechanism being placed in said timed mode in response to said control means being adjusted to said second condition and said drive mechanism being operable to cause said ball holder tube to move through said ball receiving and positioning cycle between said ball receiving and hitting positions thereof after said ball holder tube has paused and held a ball on said upper end portion of said ball holder tube in said ball hitting position for a preselected period of time.

* * * * *